US007078000B2

(12) United States Patent
Foster et al.

(10) Patent No.: US 7,078,000 B2
(45) **Date of Patent: *Jul. 18, 2006**

(54) APPARATUS AND METHOD FOR MAT PROTECTION OF NON-THERMAL PLASMA REACTOR

(75) Inventors: Michael R. Foster, Columbiaville, MI (US); Robert X. Li, Grand Blanc, MI (US); David E. Nelson, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 573 days.

This patent is subject to a terminal disclaimer.

(21) Appl. No.: 09/881,641

(22) Filed: Jun. 14, 2001

(65) Prior Publication Data

US 2002/0192130 A1 Dec. 19, 2002

(51) Int. Cl.
*B01J 19/08* (2006.01)
*F01N 3/01* (2006.01)
*F01N 7/00* (2006.01)

(52) U.S. Cl. ..... 422/186.04; 422/174; 422/179; 422/180; 422/186

(58) Field of Classification Search ..... 422/177, 422/179, 180, 186.04, 174, 186
See application file for complete search history.

(56) References Cited

U.S. PATENT DOCUMENTS

| | | | | |
|---|---|---|---|---|
| 3,450,617 | A | 6/1969 | Hellund | |
| 3,541,379 | A | 11/1970 | Holden | |
| 3,979,193 | A | 9/1976 | Sikich | |
| 4,695,358 | A | 9/1987 | Mizuno et al. | 204/174 |
| 4,795,617 | A | 1/1989 | O'Hare | 422/186.15 |
| 4,813,231 | A | 3/1989 | Bykowski | 60/274 |
| 4,945,721 | A | 8/1990 | Cornwell et al. | 60/274 |
| 5,044,157 | A | 9/1991 | Henkel | 60/274 |
| 5,141,714 | A | 8/1992 | Obuchi et al. | 422/174 |
| 5,147,516 | A | 9/1992 | Mathur et al. | 204/177 |
| 5,155,994 | A | 10/1992 | Muraki et al. | 60/275 |
| 5,236,672 | A | 8/1993 | Nunez et al. | 422/186.04 |
| 5,240,575 | A | 8/1993 | Mathur et al. | 204/177 |
| 5,324,492 | A | 6/1994 | Masuda et al. | 423/235 |

(Continued)

FOREIGN PATENT DOCUMENTS

CN 1027828 C 1/1995

(Continued)

OTHER PUBLICATIONS

Louis A. Rosocha; Los Alamos National Laboratory; *Nonthermal Plasma Applications to Pollution Control and Environmental Remediation*; First International Conference on Advanced Oxidation Technologies for Water and Air Remediation; London, Ontario, Canada, Jun. 25-30, 1994.

(Continued)

*Primary Examiner*—Hien Tran
(74) *Attorney, Agent, or Firm*—Paul L. Marshall

(57) ABSTRACT

A non-thermal plasma reactor is provided. The non-thermal plasma reactor includes a plasma-generating substrate, a housing and a mat. The plasma-generating substrate has one or more flow paths for an exhaust gas. The housing has an inlet and an outlet. The mat retains the plasma-generating substrate in the housing such that the one or more flow paths are in fluid communication with the inlet and the outlet. A voltage is supplied to the plasma-generating substrate to generate a plasma field. An electrically insulating layer is disposed between the plasma-generating substrate and the housing for preventing an arc of electricity from the plasma-generating substrate and/or the voltage to the housing.

10 Claims, 8 Drawing Sheets

U.S. PATENT DOCUMENTS

| | | | | |
|---|---|---|---|---|
| 5,419,123 | A | 5/1995 | Masters | 60/274 |
| 5,427,747 | A | 6/1995 | Kong et al. | 422/186 |
| 5,440,876 | A | 8/1995 | Bayliss et al. | 60/274 |
| 5,458,748 | A | 10/1995 | Breault et al. | 204/177 |
| 5,492,678 | A | 2/1996 | Ota et al. | 422/174 |
| 5,603,893 | A | 2/1997 | Gundersen et al. | 422/22 |
| 5,692,481 | A | 12/1997 | Miller | 123/539 |
| 5,695,619 | A | 12/1997 | Williamson et al. | 204/165 |
| 5,746,051 | A | 5/1998 | Kieser et al. | 60/275 |
| 5,746,984 | A | 5/1998 | Hoard | 422/169 |
| 5,806,305 | A | 9/1998 | Miller et al. | 60/274 |
| 5,843,383 | A | 12/1998 | Williamson et al. | 422/186.04 |
| 5,863,413 | A | 1/1999 | Caren et al. | 205/688 |
| 5,996,228 | A * | 12/1999 | Shoji et al. | 422/179 |
| 6,012,283 | A | 1/2000 | Miller et al. | 60/274 |
| 6,029,442 | A | 2/2000 | Caren et al. | 60/275 |
| 6,047,543 | A | 4/2000 | Caren et al. | 60/275 |
| 6,048,500 | A | 4/2000 | Caren et al. | 422/186.3 |
| 6,139,694 | A | 10/2000 | Rogers et al. | 204/177 |
| 6,159,430 | A | 12/2000 | Foster | 422/179 |
| 6,176,078 | B1 | 1/2001 | Balko et al. | 60/274 |
| 6,185,820 | B1 * | 2/2001 | Foster | 422/179 |
| 6,253,544 | B1 | 7/2001 | Miller et al. | 60/275 |
| 6,264,899 | B1 | 7/2001 | Caren et al. | 422/186.3 |
| 6,338,827 | B1 | 1/2002 | Nelson et al. | |
| 6,354,903 | B1 | 3/2002 | Nelson | |
| 6,368,451 | B1 | 4/2002 | Goulette et al. | |
| 6,423,190 | B1 | 7/2002 | Hemingway et al. | |
| 6,464,945 | B1 | 10/2002 | Hemingway | |
| 6,482,368 | B1 | 11/2002 | Hemingway et al. | |
| 6,537,507 | B1 | 3/2003 | Nelson et al. | |
| 6,638,484 | B1 | 10/2003 | Nelson et al. | |
| 6,797,241 | B1 * | 9/2004 | Foster | 422/186.04 |

FOREIGN PATENT DOCUMENTS

| | | | |
|---|---|---|---|
| DE | 0043477 | A2 | 6/1981 |
| DE | 3708508 | | 3/1987 |
| DE | WO94/06543 | | 3/1994 |
| DE | 0840838 | B1 | 7/1996 |
| GB | 0585047 | A2 | 8/1993 |
| GB | 2274412 | | 12/1993 |
| JP | 486974 | A | 3/1973 |
| JP | 63242323 | | 10/1988 |
| JP | 4276167 | | 10/1992 |
| JP | 05263467 | | 10/1993 |
| JP | 6015143 | | 1/1994 |
| JP | 6099031 | | 4/1994 |
| JP | 6106025 | | 4/1994 |
| JP | 6178914 | | 6/1994 |
| JP | 6182150 | | 7/1994 |
| JP | 6269635 | | 9/1994 |
| WO | WO99/18333 | | 4/1999 |
| WO | WO00/04989 | | 2/2000 |
| WO | WO00/43469 | | 7/2000 |
| WO | WO00/50743 | | 8/2000 |

OTHER PUBLICATIONS

Wachsman, Eric; Palitha Jayaweera; Victor L.K. Wong; Jon G. McCarty; Gopala Krishnan; Angel Sanjurjo; *Solid-Oxide Electrochemical Reduction and Selective Absorption of $NO_x$*; Proceedings of the 1995 Diesel Engine Emissions Reduction Workshop, San Diego California, Jul. 24-27, 1995; U.S. Department of Energy.

Huang, Shih-feng; Satoshi Ihara; Masashi Ishimine; Saburoh Satoh; Chobei Yamabe; *Reduction of $NO_x$, by a DC Positive Streamer Reactor with a Wire-to-Plane Electrodes*; Report of the Faculty of Science and Engineering, Saga University, vol. 25, 1997; pp. 27-31.

Hammer, Thomas; Stefan Broer; 982428; *Plasma Enhanced Selective Catalytic Reduction of $NO_x$ for Diesel Cars*; Copyright 1998 Society of Automotive Engineers, Inc. pp. 7-12.

Hoard, John; M. Lou Balmer; 982429; *Analysis of Plasma-Catalysis for Diesel $NO_x$ Remediation*; Copyright 1998 Society of Automotive Engineers, Inc.; pp. 13-19.

McLarnon, C.R.; V.K. Mathur; University of New Hampshire, *Nitrogen Oxide Decomposition by Barrier Discharge*; 1999 Diesel Engine Emissions Reduction Workshop, Maine Maritime Academy, Castine, Maine, Jul. 5-9, 1999; IV-73-IV-78.

Kupe, J.; Delphi Automotive Systems; *Non-Thermal Plasma Emission System for Diesel Exhaust After Treatment*; 1999 Diesel Engine Emissions Reduction Workshop; Maine Maritime Academy, Castine Maine, Jul. 5-9, 1999; IV-29-64.

Hemingway, Mark D.; Dave Goulette; Gene Ripley; Tom Thoreson; Joachim Kupe; Darrell Herling; Suresh Baskaran; Monty Smith; Del Lessor and Jud Virden; 1999-01-3639 *Evaluation of a Non-Thermal Plasma System for Remediation of $NO_x$ in Diesel Exhaust*; Copyright 1999, Society of Automotive Engineers, Inc.; pp. 59-65.

Hammer, Thomas; Tetsuo Kishimoto; Hans Miessner; Rolf Rudolph; 1999-01-3632; *Plasma Enhanced Selective Catalytic Reduction: Kinetics of $NO_x$-Removal and Byproduct Formation; Copyright 1999 Society of Automotive Engineers, Inc.* pp. 1-7.

Roth, Greg; Jim Rush; Vic Nowak; Mike Tyle; 2000-01-1845; *A Compact and Robust Corona Discharge Device (CDD™) for Generating Non-Thermal Plasma in Automotive Exhaust*; Copyright 2000 CEC and SAE International; pp. 21-34.

Herling, Darrell; Monty Smith, Mark Hemingway, David Goulette, Tom Silvis; 2000-01-2899; *Evaluation of Corona Reactors of Several Geometries for a Plasma Assisted Nitrogen Oxide Emission Reduction Device*; Copyright 2000, Society of Automotive Engineers, Inc. pp. 49-58.

Fisher, Galen B; Criag L DiMaggio; Aleksey Yezerets; Mayfair C. Kung; Harold H. Kung; Suresh Baskaran; John G. Frye; Monty R. Smith; Darrell R. Herling; William J. LeBarge; Joachim Kupe; 2000-01-2965 *Mechanistic Studies of the Catalytic Chemistry of $NO_x$ in Laboratory Plasma-Catalyst Reactors; Copyright 2000 Society of Automotive Engineers, Inc.* pp. 79-87.

* cited by examiner

APPARATUS AND METHOD FOR MAT PROTECTION OF NON-THERMAL PLASMA REACTOR

TECHNICAL FIELD

This application relates to non-thermal plasma reactors. More particularly, this application relates to an apparatus and method for protecting a retention material or mat in a plasma-generating substrate of a non-thermal plasma reactor.

BACKGROUND

The removal of nitrogen oxides (hereinafter $NO_x$) from the exhaust gases of internal combustion engines is required for cleaner operating vehicles. Improvements in fuel efficiency are achieved by operating at conditions with an excess of air than required for stoichiometric combustion (i.e., lean burn or rich conditions). Such "lean burn" conditions are commonly achieved in diesel engines and four cycle engines. However when lean-burn conditions are employed, common pollution reduction devices (e.g., three-way catalysts) are inefficient in the reduction of nitrogen oxides.

One approach to reduce nitrogen oxide pollutants in exhaust gases of engines operating under lean-burn conditions has been to incorporate a non-thermal plasma reactors in the exhaust lines along in addition to the standard three-way catalyst. Such reactors treat the exhaust gases using a non-thermal plasma field. The non-thermal plasma field is a high local electric field. The plasma converts NO to $NO_2$, the $NO_2$ must then be subsequently reduced by a selective catalyst. For example, a non-thermal plasma reactor is described in U.S. Pat. No. 6,139,694, the contents of which are incorporated by reference herein.

Non-thermal plasma reactors include a non-thermal plasma-generating substrate ("substrate") disposed within a housing. The substrate includes a pair of dielectric plates spaced from one another to form an exhaust gas flow channel. Preferably, the dielectric plates are non-conductive materials such as quartz, glass, alumina, mullite, and oxide free ceramics (e.g., silicon nitrite, boron nitrite, aluminum nitrite). A voltage supply is connected to a pair of electrodes on each dielectric plate for providing a voltage between the dielectric plates in order to generate the plasma field in the flow channel between the plates. The exhaust gas flows through the flow channel, exposing the gas to the plasma field. The plasma field converts $NO_x$ into either individual elemental diatoms $O_2$ and $N_2$ and/or nitrogen dioxide $NO_2$.

The flow channels in the reactor are preferably long, narrow rectangular gas channels. However, such long, narrow substrates are prone to crushing due the forces necessary to restrain the substrate in the housing. The plates of the substrate are also prone to arcing of voltage from the plates to the housing. Moreover, the substrate is subject to heating and cooling cycles, which places an additional strain on the substrate. These factors and others create obstacles with respect to retaining the substrate in the reactor.

SUMMARY

A non-thermal plasma reactor having a plasma-generating substrate, a housing and a mat is provided. The plasma-generating substrate has one or more flow paths for an exhaust gas. The housing has an inlet and an outlet. The mat retains the plasma-generating substrate in the housing such that the one or more flow paths are in fluid communication with the inlet and the outlet. A voltage is supplied to the plasma-generating substrate to generate a plasma field. An electrically insulating layer is disposed between the plasma-generating substrate and the housing for preventing an arc of electricity from the plasma-generating substrate and/or the voltage to the housing.

A non-thermal plasma reactor having a plasma-generating substrate, a housing, a mat and a retaining device is provided. The plasma-generating substrate has one or more flow paths for an exhaust gas. The housing has an inlet and an outlet. The mat retains the plasma-generating substrate in the housing such that the one or more flow paths are in fluid communication with the inlet and the outlet. A voltage is supplied to the plasma-generating substrate to generate a plasma field. The retaining device diffuses the exhaust gas away from the mat.

A method of forming a non-thermal plasma reactor is provided. The method includes providing a plasma-generating substrate, disposing the plasma-generating substrate in a housing, retaining the plasma-generating substrate in the housing with a mat, and supplying a voltage to the plasma-generating substrate for generating a plasma field. The plasma-generating substrate has one or more flow paths for an exhaust gas. The plasma-generating substrate is disposed in the housing such that the one or more flow paths are in fluid communication with the inlet and the outlet. The retaining device diffuses the exhaust gas away from the mat, distributes a low retention force of the mat to a weak side of the plasma-generating substrate, and distributes a high retention force of the mat to a medium strength area, a high strength area of the plasma-generating substrate, and to the areas where gas seals are required.

The above-described and other features and advantages of the present invention will be appreciated and understood by those skilled in the art from the following detailed description, drawings, and appended claims.

DESCRIPTION OF THE PREFERRED EMBODIMENT

Figure 2:
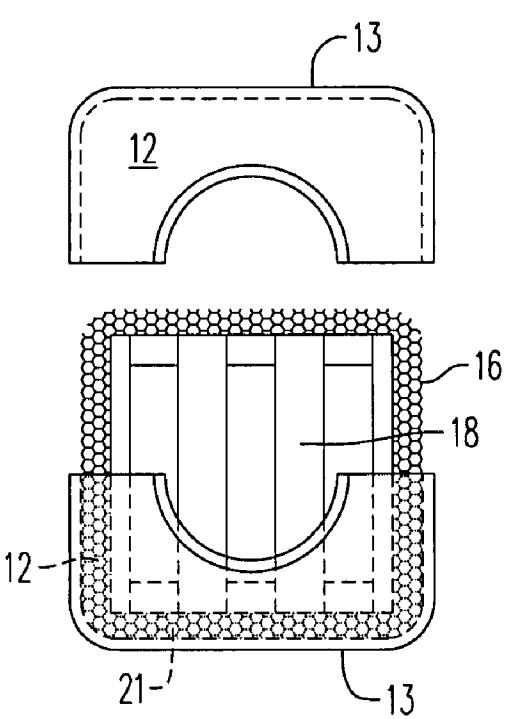
FIG. 2 is a front view of the non-thermal plasma reactor of FIG. 1.
Figure 1:
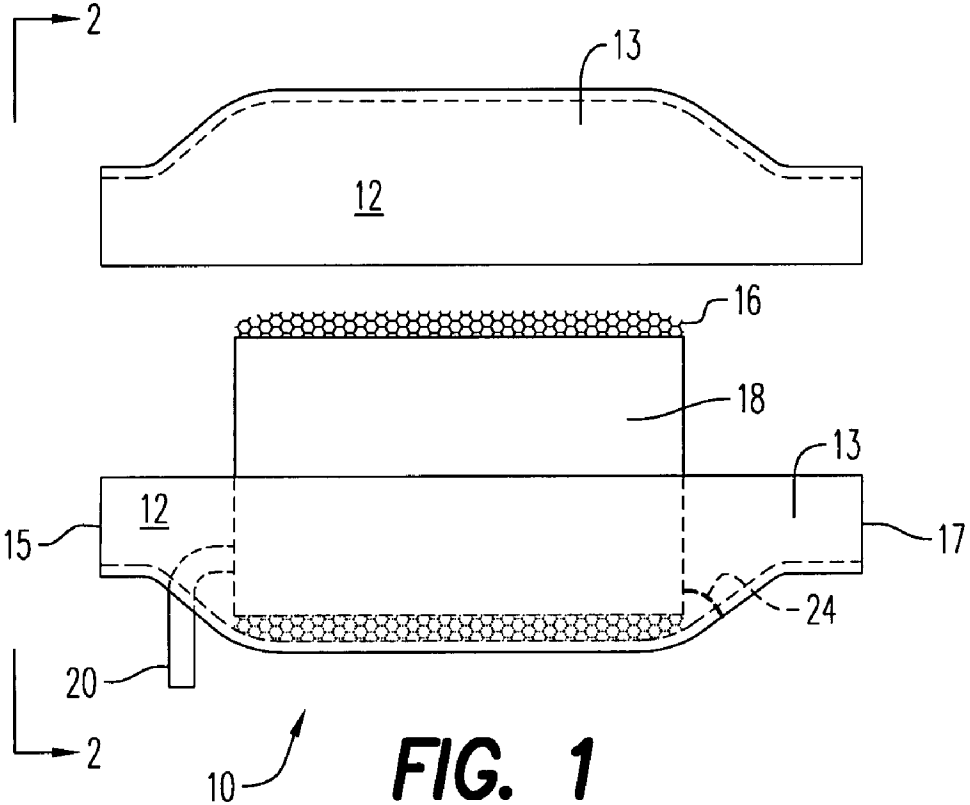
FIG. 1 is a side exploded view of an exemplary embodiment of a non-thermal plasma reactor.

Referring now to FIGS. 1 and 2, a non-thermal plasma reactor is shown generally at 10. Non-thermal plasma reactor 10 (reactor) includes a housing 12 illustrated as a pair of shells 13. As illustrated, housing 12 is an elongated rectangle. However, it should be recognized that housing 12 having alternate configurations, such as, but not limited to elongated circles are considered within the scope of this application. Reactor 10 includes a retention material or mat 16 and a substrate 18. Mat 16 is adapted to retain substrate 18 in housing 12. Preferably, housing 12 is made of material capable of withstanding the high temperature, high corrosive working environment of reactor 10. For example, housing 12 is made of metal, such as stainless steel.

Substrate 18 and housing 12 have a rectangular cross section. Preferably, substrate 18 is wrapped with mat 16 and is placed between shells 13. Shells 13 are connected to one another securing substrate 18 therein. As illustrated in FIG. 1, reactor 10 includes a voltage port 20 and a ground 24. Voltage port 20 supplies high voltage electricity to substrate 18.

It should be recognized that housing 12, mat 16 and substrate 18 are described above by way of example only as having two-piece construction and rectangular cross-sections. However, any combination of multiple piece construction and corresponding cross sections are considered within the scope of the present invention.

Substrate 18 includes an inked or electrically active area 21. Mat 16 forms an interference-fit with housing 12 to hold substrate 18 in place and provides adequate spacing, typically a minimum of 19 mm, to isolate the housing from electrically active area 21 of the substrate to prevent electrical arcing. Moreover, voltage port 20, being closer to housing 12 than electrically active area 21, is also electrically isolated.

Mat 16 fills the area between housing 12 and substrate 18, and retains the substrate in the housing. Preferably, mat 16 is a compressible fiber material and is made of a high temperature resistive ceramic fiber material, preferably comprising alumina. Mat 16 is adapted to absorb the thermal expansion and compression of substrate 18, which is in the range of about $7\times10^{-6}$ mm per degree Celsius. For example, mat 16 is 1100 HT supplied by 3M Company, which is capable of withstanding the temperature environment within reactor 10 and is capable of retaining substrate 18 throughout the expansion and contraction of the substrate.

Mat 16 erodes when exposed to the exhaust gas and becomes contaminated with a build-up of carbon from the exhaust gas. Since carbon is electrically conductive, carbon build-up on mat 16 creates an electrical pathway between substrate 18 and housing 12 that interferes with proper operation of reactor 10. Arcing due to carbon build-up is especially problematic at voltage port 20 where spacing is diminished.

Figure 3:
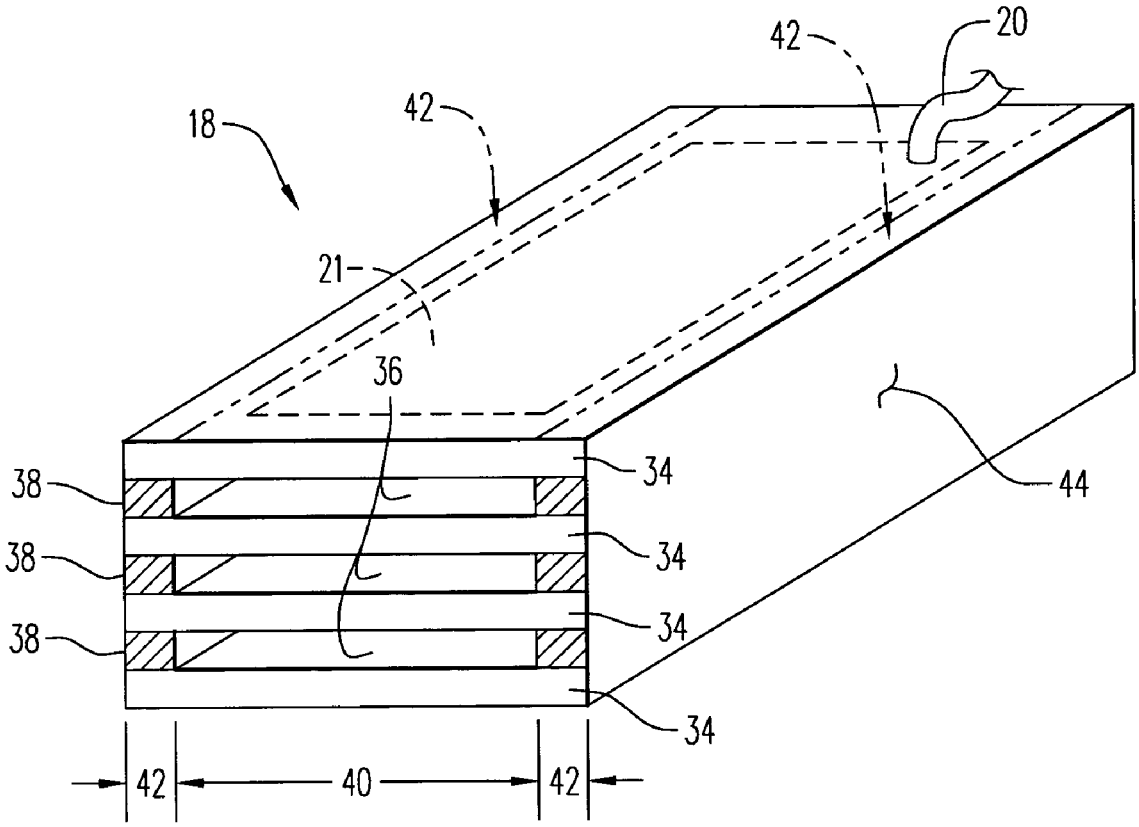
FIG. 3 is a perspective view of a substrate of a non-thermal plasma reactor.

Substrate 18 is described with reference to FIG. 3. Substrate 18 includes a plurality of ceramic plates 34, disposed in a spaced relation to form long rectangular cells or openings 36. Preferably, openings 36 between plates 34 are maintained by spacers 38, which serve as vertical support for substrate 18. In use, exhaust gas is directed into openings 36 and high voltage electricity is applied to each plate 34 to generate the non-thermal plasma necessary to convert $NO_x$ into either individual elemental diatoms $O_2$ and $N_2$ and/or nitrogen dioxide $NO_2$.

Long rectangular cells or openings 36 create structurally weak zones or areas 40 in substrate 18. Areas 40 can only withstand low compression forces and makes the substrate 18 prone to crushing in these weak areas if larger forces are encountered. For example, where plates 34 have a thickness of about 1.5 mm a force of about 6 psi to about 17 psi in weak area 40 may damage substrate 18.

Substrate 18 also includes medium strength areas 42 and high strength areas 44, namely the portions of plates 34 supported by spacers 38. The varying strength of areas 40, 42 and 44 affects how substrate 18 is retained in the housing 12.

The retaining devices described below are adapted to provide high axial compression of mat 16 at medium strength areas 42 and high strength areas 44, but the low radial compression at low strength areas 40.

Figure 4:
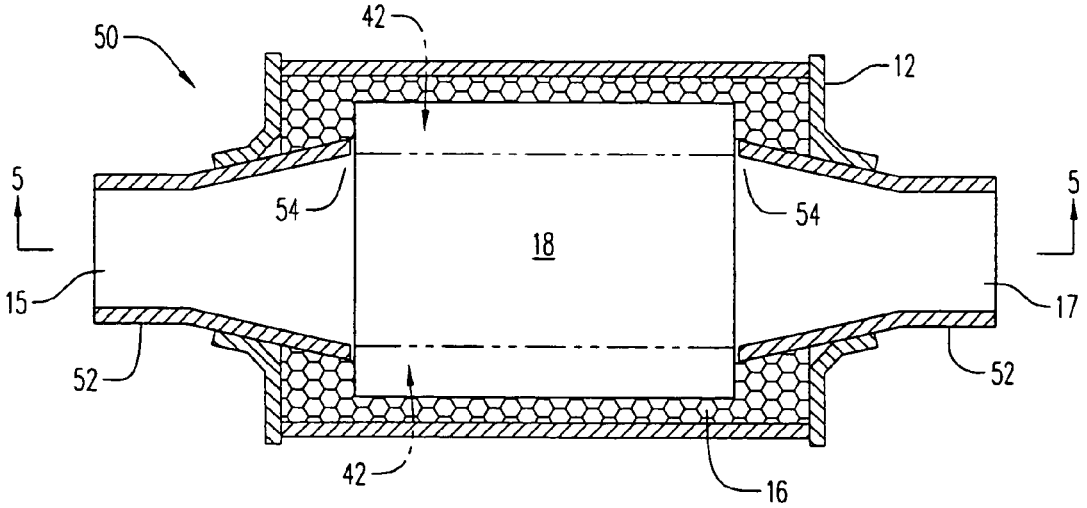
FIG. 4 is a cross sectional view of an exemplary embodiment of a retaining device for a non-thermal plasma reactor.
Figure 5:
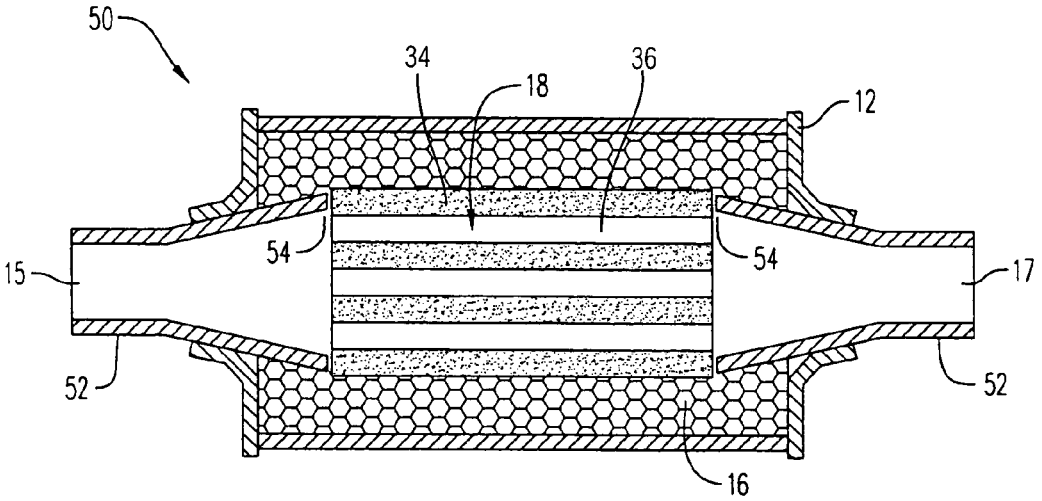
FIG. 5 is a view along lines 5—5 of FIG. 4.

Referring now to the embodiment of FIGS. 4 and 5, substrate 18 is further retained in housing 12 by a retaining device 50 such that openings 36 of the substrate are adjacent inlet 15 and outlet 17. Retaining device 50 is adapted to reduce the exposure of mat 16 to exhaust gas. Thus, retaining device 50 reduces the build-up of carbon on mat 16. Retaining device 50 is an enhanced diffusion header 52 disposed at inlet 15 and outlet 17 of housing 12. More specifically, header 52 has an inside end 54 that is in close proximity to opening 36 of substrate 18. Preferably, inside end 54 is in a range of about 0.5 mm to 1.5 mm from substrate 18. More preferably, inside end 54 is about 1 mm from substrate 18. Header 52 causes the exhaust gas to expand without energy loss and uniformly flow through substrate 18. Thus, header 52 act as a diffuser to direct the flow of exhaust gas into opening 36 and to minimize the amount of exhaust gas that contacts mat 16. Moreover, retaining device 50 more effectively distributes the compression forces from the mat to substrate 18.

Figure 6:
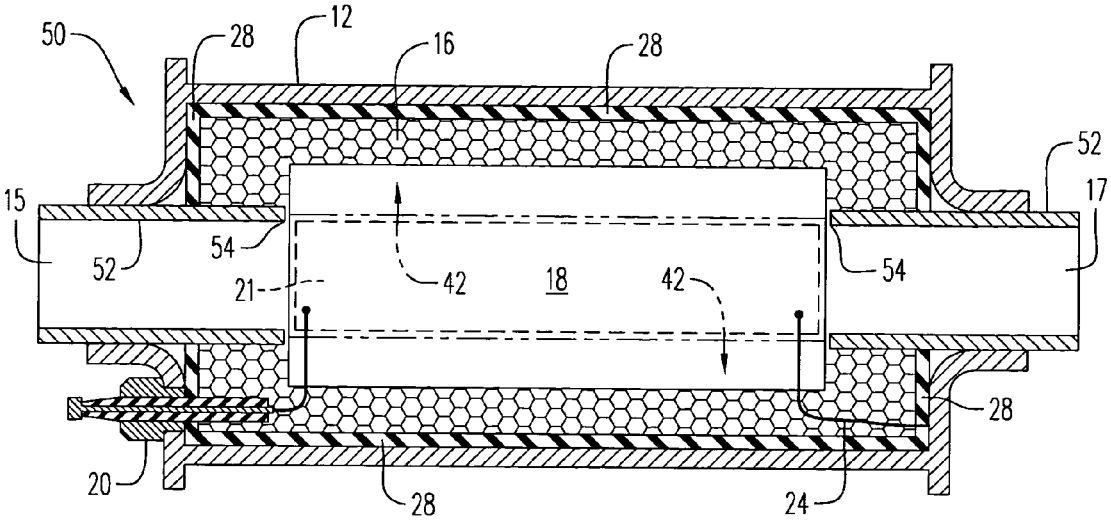
FIG. 6 is cross sectional view of an alternate exemplary embodiment of the non-thermal plasma reactor using the retaining device of FIG. 4.

An alternate embodiment of non-thermal plasma reactor 10 is illustrated by way of example in FIG. 6 using retaining device 50. Reactor 10 further includes an insulating layer 28 disposed between housing 12 and substrate 18. As discussed above, substrate 18 is held in housing 12 with adequate spacing, to isolate the housing and the substrate to prevent electrical arcing. Insulating layer 28 further insulates electrically active area 21 and voltage port 20 from housing 12 such that the spacing between the housing and the substrate is reduced to about 6 mm to 9 mm. Accordingly, a reduction in size and cost of reactor 10 is achieved through the use of insulating layer 28. Preferably, layer 28 is a layer of mica or other electrically insulating material. In one embodiment layer 28 is placed between housing 12 and substrate 18 during assembly. In alternate embodiments layer 28 is sprayed, printed or the like onto housing 12 and/or substrate 18 prior to assembly of reactor 10.

Figure 7:
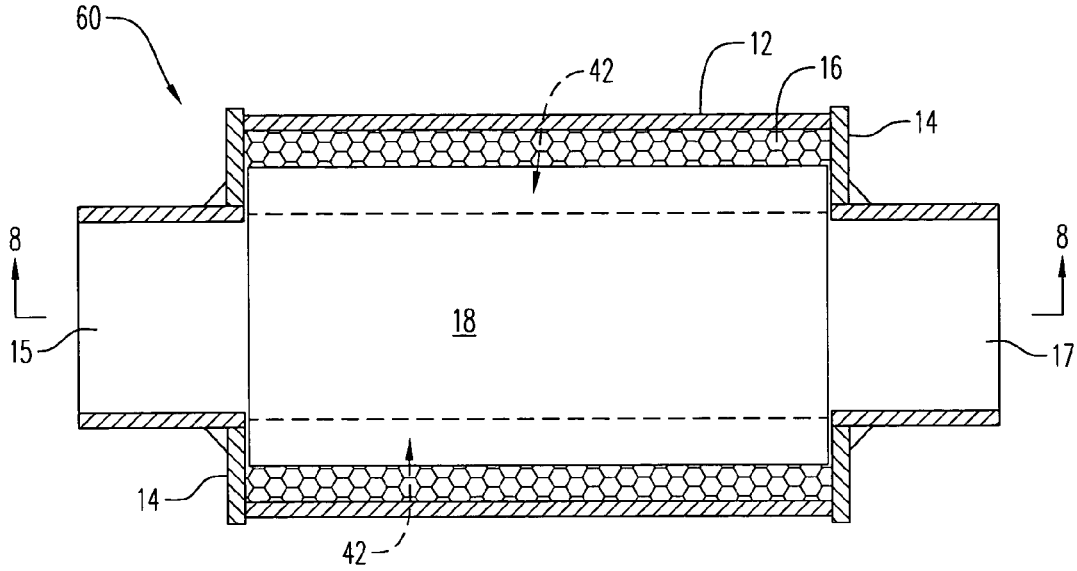
FIG. 7 is a cross sectional view of another exemplary embodiment of a retaining device for a non-thermal plasma reactor.
Figure 8:
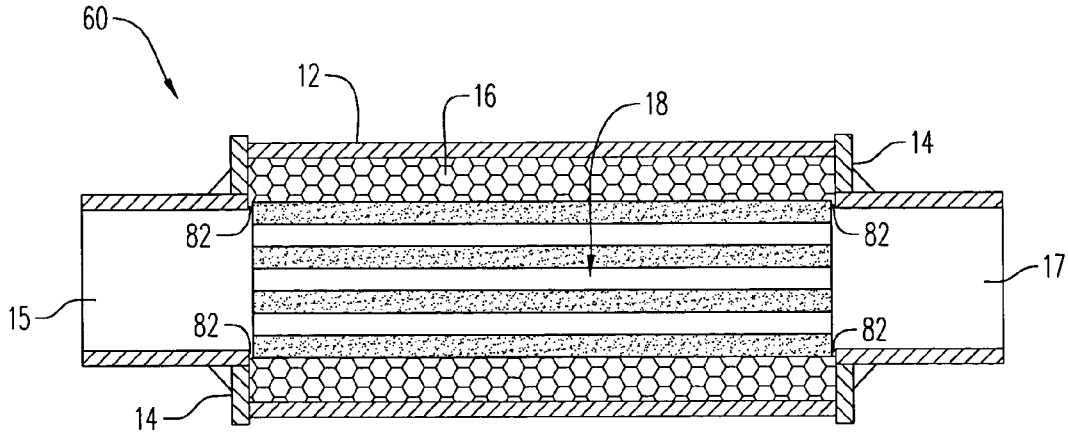
FIG. 8 is a cross sectional view along lines 8—8 of FIG. 7.

Referring now to the embodiment of FIGS. 7 and 8, substrate 18 is further retained in housing 12 by a retaining device 60 such that openings 36 of the substrate are adjacent inlet 15 and outlet 17. Retaining device 60 is also adapted to reduce the exposure of mat 16 to exhaust gas. Retaining device 60 is formed by end 14 of housing 12. More specifically, housing 12 is dimensioned with respect to substrate 18 such that end 14 is in close proximity to opening 36 of substrate 18. Preferably, end 14 is in a range of about 0.5 mm to 1.5 mm from substrate 18. More preferably, end 14 is about 1 mm from substrate 18. Thus, end 14 acts as a diffuser to direct the flow of exhaust gas into opening 36 and to minimize the amount of exhaust gas that contacts mat 16. Moreover, retaining device 60 more effectively distributes the compression forces from the mat to substrate 18.

Figure 9:
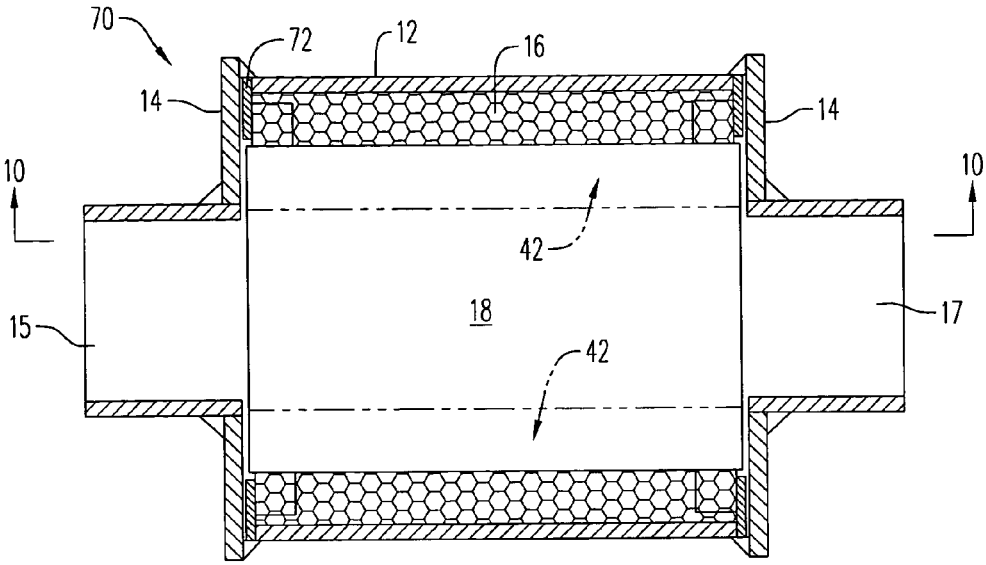
FIG. 9 is a cross sectional view of another exemplary embodiment of a retaining device for a non-thermal plasma reactor.
Figure 10:
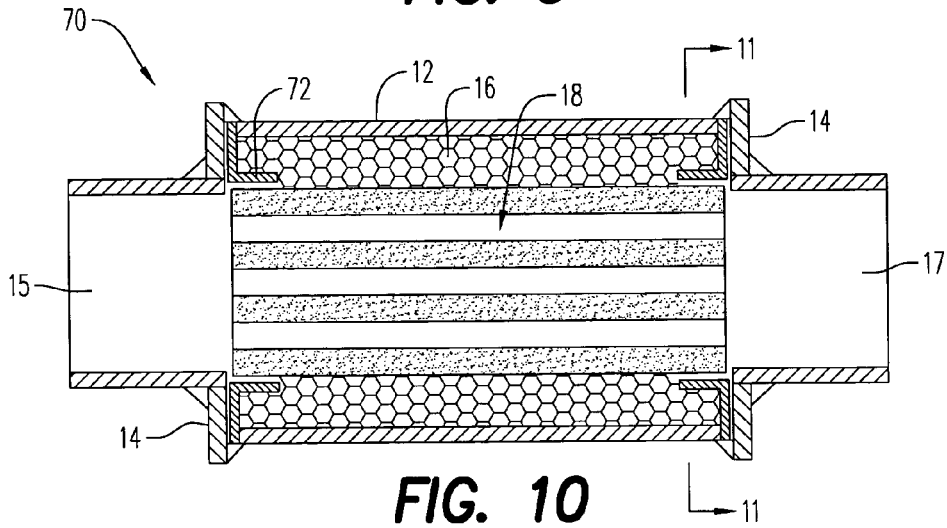
FIG. 10 is a cross sectional view along lines 10—10 of FIG. 9.
Figure 11:
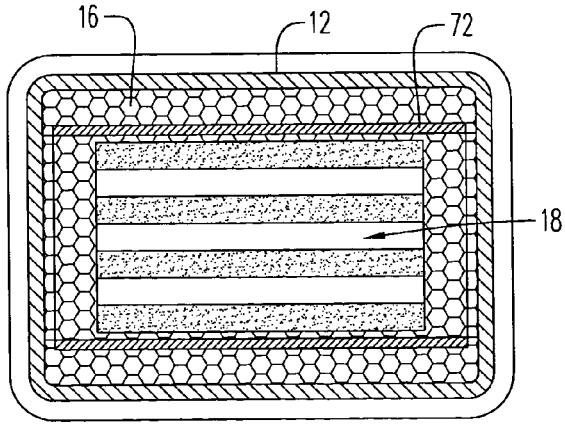
FIG. 11 is a view along lines 11—11 of FIG. 9.

Referring now to the embodiment of FIGS. 9–11, substrate 18 is further retained in housing 12 by a retaining device 70 such that openings 36 of the substrate are adjacent inlet 15 and outlet 17. Retaining device 70 is an overlap seal ring 72. More specifically, seal ring 72 is sealed between housing 12 and ends 14. Preferably, seal ring 72 is positioned in a range of about 0.5 mm to 1.5 mm from substrate 18. More preferably, seal ring 72 is about 1 mm from substrate 18. Thus, seal ring 72 acts as a diffuser to direct the flow of exhaust gas into opening 36 and to minimize the amount of exhaust gas that contacts mat 16. It is necessary because the mat adjacent to area 40 must have a low density, less than 0.3 grams/cc to avoid excessive force on area 40. However, at this low density mat 16 is subject to erosion from the exhaust gasses, if unprotected. Moreover, retaining device 70 more effectively distributes the compression forces from mat 16 to substrate 18.

Figure 12:
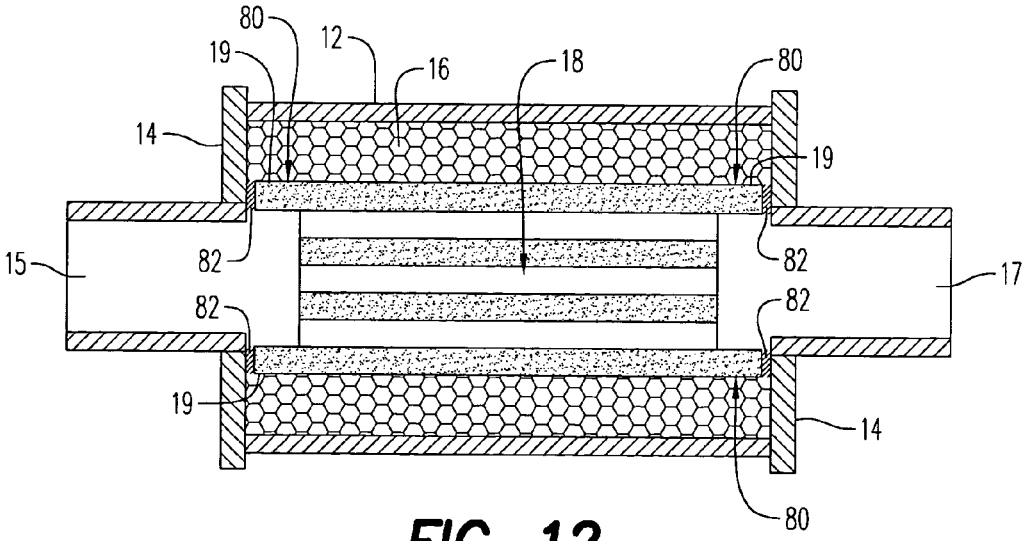
FIG. 12 is a cross sectional view of another exemplary embodiment of a retaining device for a non-thermal plasma reactor.

Referring now to the embodiment of FIG. 12, substrate 18 is further retained in housing 12 by a retaining device 80. Retaining device 80 is an extension 19 of the peripheral edges of the outer ceramic plates 34 of substrate 18. Extensions 19 are in close proximity to ends 14 of housing 12 to diffuse the flow of exhaust gas into opening 36. Preferably, extensions 19 are positioned in a range of about 0.5 mm to 1.5 mm from end 14 and extend from substrate 18 by about 5 mm to 10 mm. More preferably, extensions 19 are about 1 mm from ends 14 and extend from substrate 18 by about 7.5 mm. Accordingly, the close proximity of extensions 19 and end 14 minimizes the amount of exhaust gas that contacts mat 16. In order to further reduce the exposure of exhaust gas to mat 16 at retaining device 80, the mat at the interface of extensions 19 and ends 14 is coated with a sealant 82. Sealant 82 is adapted to seal mat 16 such that exhaust gases do not pass through the space between extensions 19 and ends 14. In a preferred embodiment, sealant 82 is mat 16 compressed to a density above 0.3 grams/cc by placing the mat between the end plate 14 and extension 19 during assembly of reactor 10. It should be noted that use of sealant 82 in the form of mat 16 compressed to a density above 0.3 grams/cc is also available for the embodiment of FIGS. 7 and 8 described above.

Figure 13:
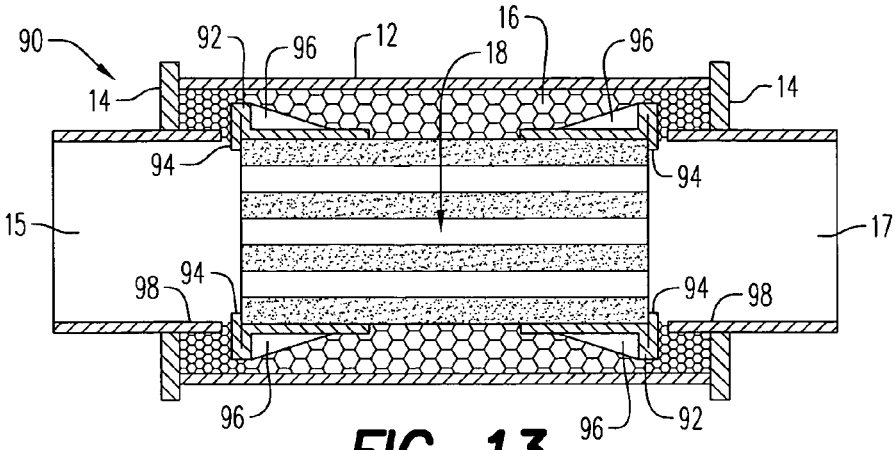
FIG. 13 is a cross sectional view of another exemplary embodiment of a retaining device for a non-thermal plasma reactor.
Figure 14:
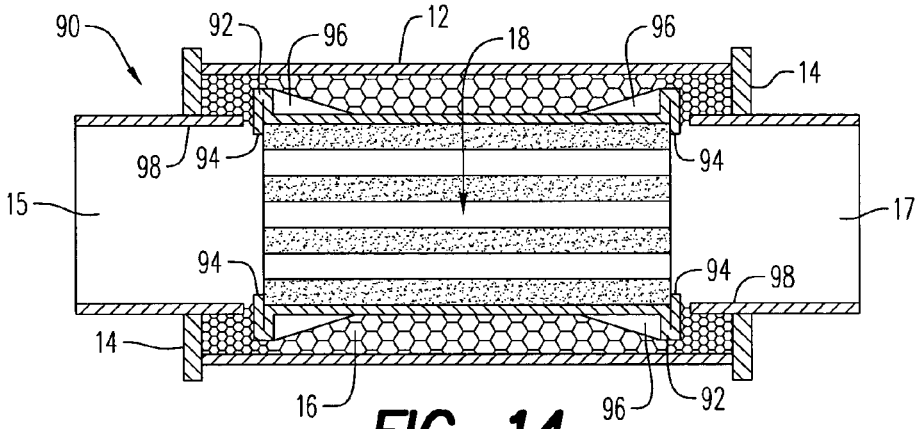
FIG. 14 is a cross sectional view of an alternate embodiment of the retaining device of FIG. 13.

Referring now to the embodiments illustrated in FIGS. 13 and 14, substrate 18 is further retained in housing 12 by a retaining device 90. Retaining device 90 reduces the exposure of mat 16 to exhaust gas and more effectively distributes the compression forces from the mat to substrate 18. Retaining device 90 is a compression stop 92. Retaining stop 92 compresses mat 16 to a density greater than 0.3 gram/cc between the retaining stop and end plate 14 without applying the relatively high forces generated by this compression to area 40. Thus, mat 16 has a density less than 0.3 grams/cc, while the mat between stop 92 and end plate 14 has a density greater than 0.3 gram/cc for high erosion resistance. Stop 92 has an overlap portion 94 that overlaps substrate 18 at openings 36 to distribute the axial compressive load to areas 42 and 44 of the substrate. Preferably, stop 92 includes one or more reinforcing ribs 96. Reinforcing ribs help to transmit radial compressive loading on weak zones 40 of substrate 18 to areas 42 and 44 by preventing the stop from bending toward the substrate, and to prevent stop 92 from bending due to the high compressive loads from mat 16 between stop 92 and end plate or end 14.

Ends 14 include an enhanced diffusion header 98 disposed at inlet 15 and outlet 17 of housing 12. More specifically, header 98 is in close proximity to overlap portion 94. Preferably, header 98 is in a range of about 0.5 mm to 1.5 mm from overlap portion 94. More preferably, header 98 is about 1 mm from overlap portion 94. Thus, header 98 and stop 92 act as a diffuser to direct the flow of exhaust gas into opening 36 and to minimize the amount of exhaust gas that contacts mat 16. Mat 16 in this area is also compressed to a high density so it is resistant to erosion. Thus, stops 92 avoid placing the high compressive loads from mat 16 on weak areas 40. Moreover, the cooperation of overlap portion 94 and ribs 96 with substrate 18 more evenly distributes the axial and radial compression from mat 16 to areas 42 and 44 of substrate 18. In the embodiment of FIG. 14, stops 92 are formed as separate pieces. Conversely, in the embodiment of FIG. 15 stops 92 are formed as a single piece.

Figure 15:
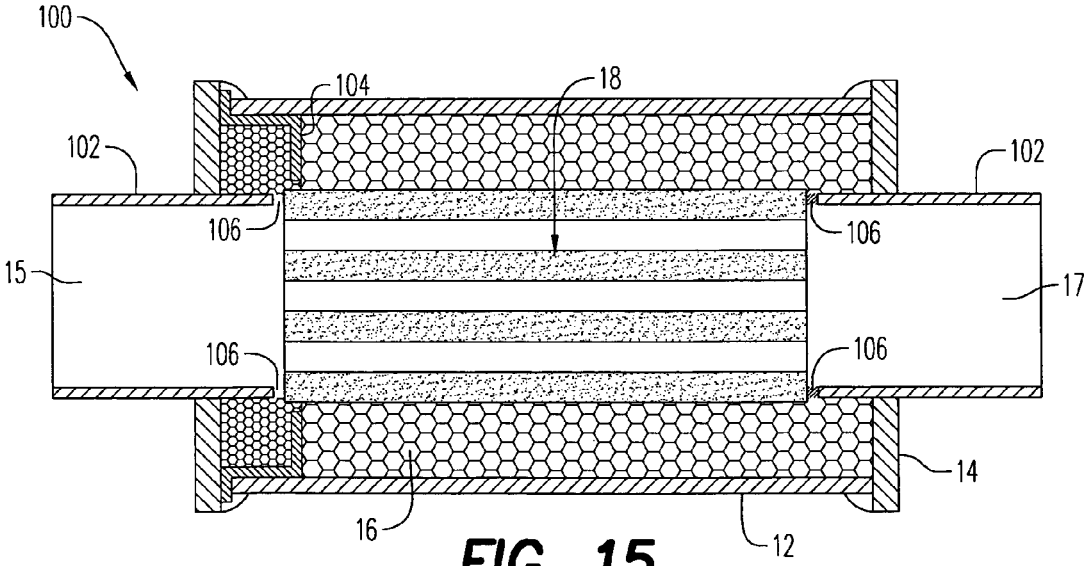
FIG. 15 is a cross sectional view of another exemplary embodiment of a retaining device for a non-thermal plasma reactor.

Referring now to the embodiment of FIG. 15, substrate 18 is further retained in housing 12 by a retaining device 100. Retaining device 100 includes an enhanced diffusion header 102 disposed at inlet 15 and outlet 17 of housing 12 and a retaining ring 104 disposed between the housing and ends 14. More specifically, header 102 has an inside end 106 that is in close proximity to opening 36 of substrate 18. Preferably, inside end 106 is in a range of about 0.5 mm to 1.5 mm from opening 36. More preferably, inside end 106 is about 1 mm from opening 36. Header 102 causes the exhaust gas to expand without energy loss and uniformly flow through substrate 18. Retaining ring 104 compresses mat 16 to a high density between the retaining ring and end plate 14 without applying the forces from this compression to weak area 40. Accordingly, mat 16 adjacent to inside end 106 is highly resistant to erosion. For purposes of clarity retaining ring 104 is shown only at inlet opening 15. However, it is considered within the scope of the present invention for retaining ring 104 to be used at outlet opening 17, and/or at both inlet opening 15 and outlet opening 17. Thus, retaining ring 104 further minimizes the amount of exhaust gas that contacts mat 16. More specifically, retaining ring 104 is in close proximity to substrate 18. Preferably, retaining ring 104 is in a range of about 0.5 mm to 1.5 mm from substrate 18. More preferably, retaining ring is about 1 mm from substrate 18. Thus, header 102 and retaining ring 104 act to diffuser the flow of exhaust gas into opening 36 and to minimize the amount of exhaust gas that contacts mat 16.

It should be noted that insulating layer 28 and sealant 82 are described above by way of example as being used with retaining devices 50 and 80, respectively. However, it is considered within the scope of the present invention for such insulating layers and sealants to be used with any of the retaining devices described herein.

Figure 16:
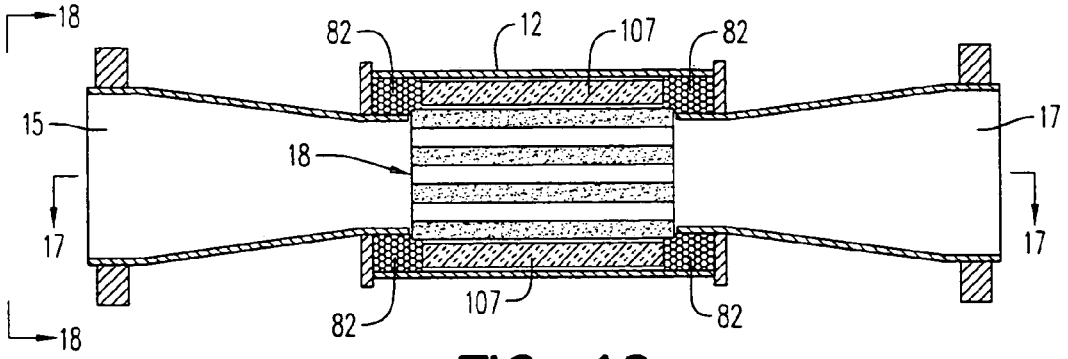
FIG. 16 is a cross sectional view of another exemplary embodiment of a retaining device for a non-thermal plasma reactor.
Figure 17:
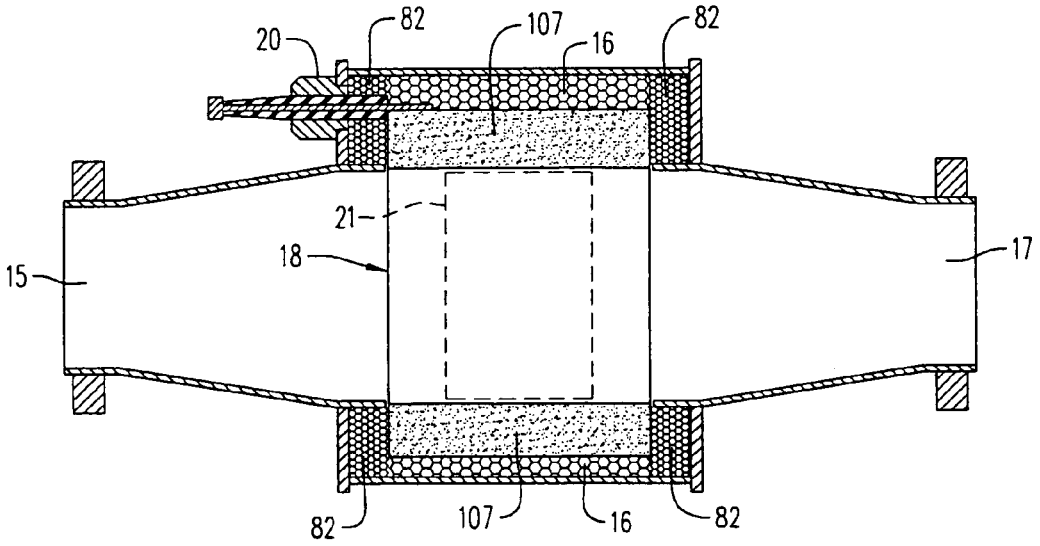
FIG. 17 is a cross sectional view along lines 17—17 of FIG. 16.
Figure 18:
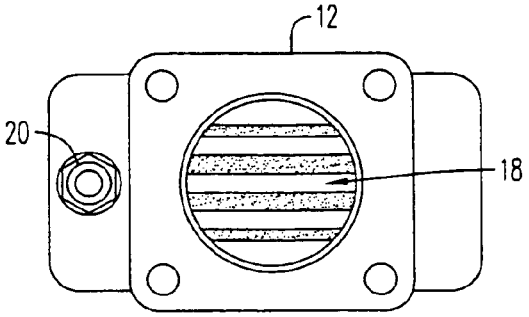
FIG. 18 is an end view along lines 18—18 of FIG. 16.

Referring now to the embodiment of FIGS. 16–18, substrate 18 is further retained in housing 12 by a retaining device 107. Retaining device 107 is a rigid insulation board disposed adjacent weak areas 40 of substrate 18. Thus, retaining device 107 minimizes forces on weak areas 40, and provides a "stop" for mat 16 used at each end of substrate 18.

Thus, retaining device 107, compresses mat 16 to a density above 0.3 grams/cc by placing the mat between the end plate 14 and the retaining device during assembly of reactor 10. Accordingly, retaining device 107 provides sealant 82 to further protect mat 16.

While preferred embodiments have been shown and described, various modifications and substitutions may be made thereto without departing from the spirit and scope of the invention. Accordingly, it is to be understood that the present invention has been described by way of illustration only, and such illustrations and embodiments as have been disclosed herein are not to be construed as limiting to the claims.

The invention claimed is:

1. A non-thermal plasma reactor, comprising:

a plasma-generating substrate having one or more flow paths for an exhaust gas;

a housing having an inlet and an outlet such that said one or more flow paths are in fluid communication with said inlet and said outlet;

a mat disposed about said plasma-generating substrate for retaining said plasma-generating substrate in said housing;

a voltage supplied to said plasma-generating substrate for generating a plasma field; and an electrically insulating layer disposed between said mat and said housing for preventing an arc of electricity from said plasma-generating substrate and/or said voltage to said housing.

2. The non-thermal plasma reactor of claim 1, further comprising a diffusion header for diffusing said exhaust gas to said plasma-generating substrate and away from said mat.

3. The non-thermal plasma reactor of claim 1, wherein said insulating layer is a mica layer.

4. The non-thermal plasma reactor of claim 2, wherein said diffusion header comprises an end spaced apart from the plasma-generating substrate.

5. The non-thermal plasma reactor of claim 4, wherein said end is spaced apart from said plasma-generating substrate by between about 0.5 mm to 1.5 mm.

6. The non-thermal plasma reactor of claim 1, wherein said plasma-generating substrate includes peripheral extensions in close proximity to said inlet and said outlet.

7. The non-thermal plasma reactor of claim 2, further comprising a sealant on said mat at an interface of said diffusion header said plasma-generating substrate.

8. A non-thermal plasma reactor, comprising:

a plasma-generating substrate having one or more flow paths for an exhaust gas;

a housing having an inlet and an outlet, said housing comprising an end plate;

a mat retaining said plasma-generating substrate in said housing;

a voltage supplied to said plasma-generating substrate for generating a plasma field; and a compression stop disposed about said plasma-generating substrate apart from housing, whereby said mat is compressed to a density greater than 0.3 grams/cc between said end plate and said compression stop and a density less than 0.3 grams/cc laterally about said plasma-generating substrate.

9. The non-thermal plasma reactor of claim 8, further comprising an enhanced diffusion header spaced apart from said compression stop.

10. The non-thermal plasma reactor of claim 9, wherein said diffusion header comprises an end spaced apart from said compression stop by about 0.5 and 1.5 mm.

* * * * *